US009175817B2

(12) United States Patent
Hoelen et al.

(10) Patent No.: US 9,175,817 B2
(45) Date of Patent: Nov. 3, 2015

(54) LIGHT SOURCE COMPRISING A LIGHT EMITTER ARRANGED INSIDE A TRANSLUCENT OUTER ENVELOPE

(75) Inventors: Christoph Gerard August Hoelen, Eindhoven (NL); Roger Cornelis Petrus Hoskens, Shanghai (CN); Rene Theodorus Wegh, Eindhoven (NL); Nibu Ampalathumkal George, Eindhoven (NL); Xiaoqing Duan, Shanghai (CN); Timothy Howard Rider, Shanghai (CN); Lei Shi, Shanghai (CN); Johannes Petrus Maria Ansems, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 540 days.

(21) Appl. No.: 13/318,788

(22) PCT Filed: Apr. 23, 2010

(86) PCT No.: PCT/IB2010/051793

§ 371 (c)(1),
(2), (4) Date: Mar. 7, 2012

(87) PCT Pub. No.: WO2010/128419

PCT Pub. Date: Nov. 11, 2010

(65) Prior Publication Data

US 2012/0155059 A1 Jun. 21, 2012

(30) Foreign Application Priority Data

May 4, 2009 (CN) ..... 2009 1 0139350

(51) Int. Cl.
*F21K 99/00* (2010.01)
*F21V 3/00* (2015.01)
(Continued)

(52) U.S. Cl.
CPC . *F21K 9/56* (2013.01); *F21K 9/135* (2013.01); *F21V 3/00* (2013.01); *F21V 3/02* (2013.01);
(Continued)

(58) Field of Classification Search
CPC ..... F21V 3/04–3/049; F21V 5/007; F21V 5/0041; F21V 7/045; F21V 7/05; F21V 7/06; F21V 7/16; F21V 7/22; G02B 13/005; G02B 17/0678; G02B 5/0231; G02B 7/027
USPC ..... 362/249.02, 255–256, 267–268, 291, 362/294, 311.01–311.02, 329, 331, 362/355–357, 361, 84
See application file for complete search history.

(56) References Cited

U.S. PATENT DOCUMENTS 3,949,350 A * 4/1976 Smith ..... 362/86
6,676,284 B1 * 1/2004 Wynne Willson ..... 362/555
(Continued)

FOREIGN PATENT DOCUMENTS

DE 102007045540 A1 4/2009
DE 202008017116 U1 4/2009
(Continued)

*Primary Examiner* — Peggy Neils
*Assistant Examiner* — Zheng Song
(74) *Attorney, Agent, or Firm* — Yuliya Mathis

(57) ABSTRACT

The invention relates to a light source (10, 12) comprising a light emitter (20) arranged inside a translucent outer envelope (30, 32). The light emitter comprising a light emitting device (40) and comprising a translucent inner envelope (50) at least partially surrounding the light emitting device, the translucent inner envelope comprising a diffuser. A diameter ($d_i$) of the translucent inner envelope is smaller than a diameter ($d_o$) of the translucent outer envelope. The translucent outer envelope is connected to a base (60) not being translucent. The translucent outer envelope further comprises a symmetry axis (S). An imaginary base-plane (P) is defined substantially perpendicular to the symmetry axis (S) and intersects with a connection point (C) being part of the translucent outer envelope. The connection point is a light transmitting part of the translucent outer envelope at an interface between the translucent outer envelope and the base at a furthest distance from a center (M) of the translucent outer envelope.

14 Claims, 5 Drawing Sheets

(51) Int. Cl.

| | |
|---|---|
| ***F21V 3/02*** | (2006.01) |
| ***F21V 3/04*** | (2006.01) |
| *F21Y 101/02* | (2006.01) |
| *F21Y 111/00* | (2006.01) |
| *F21V 29/77* | (2015.01) |

(52) U.S. Cl.

CPC ..... *F21V 3/0481* (2013.01); *F21K 9/1355* (2013.01); *F21V 29/77* (2015.01); *F21Y 2101/02* (2013.01); *F21Y 2111/007* (2013.01)

(56) References Cited

U.S. PATENT DOCUMENTS

| | | | | |
|---|---|---|---|---|
| 7,192,161 | B1 * | 3/2007 | Cleaver et al. | 362/260 |
| 7,497,596 | B2 * | 3/2009 | Ge | 362/294 |
| 7,588,351 | B2 * | 9/2009 | Meyer | 362/294 |
| 7,600,882 | B1 * | 10/2009 | Morejon et al. | 362/84 |
| 7,602,559 | B2 * | 10/2009 | Jang et al. | 359/726 |
| 2005/0018432 | A1 * | 1/2005 | Buschmann et al. | 362/328 |
| 2005/0242701 | A1 * | 11/2005 | Nomura et al. | 313/483 |
| 2005/0264194 | A1 * | 12/2005 | Ng et al. | 313/512 |
| 2006/0028837 | A1 * | 2/2006 | Mrakovich | 362/602 |
| 2006/0198147 | A1 | 9/2006 | Ge | |
| 2008/0310158 | A1 | 12/2008 | Harbers et al. | |
| 2009/0086492 | A1 | 4/2009 | Meyer | |
| 2009/0175041 | A1 * | 7/2009 | Yuen et al. | 362/294 |
| 2009/0251882 | A1 * | 10/2009 | Ratcliffe | 362/84 |
| 2012/0086034 | A1 * | 4/2012 | Yuan et al. | 257/98 |

FOREIGN PATENT DOCUMENTS

| | | | |
|---|---|---|---|
| EP | 2025992 | A2 | 2/2009 |
| GB | 2366610 | A | 3/2002 |
| JP | 3137575 | A | 6/1991 |
| JP | 3148997 | U | 3/2001 |
| JP | 2003173703 | A | 6/2003 |
| JP | 2006156187 | A | 6/2006 |
| JP | 2006228692 | A | 8/2006 |
| JP | 2006313718 | A | 11/2006 |
| JP | 2008021505 | A | 1/2008 |
| WO | 2009035693 | A1 | 3/2009 |

* cited by examiner

LIGHT SOURCE COMPRISING A LIGHT EMITTER ARRANGED INSIDE A TRANSLUCENT OUTER ENVELOPE

FIELD OF THE INVENTION

The invention relates to a light source comprising a light emitter arranged inside a translucent outer envelope.

BACKGROUND OF THE INVENTION

Light sources comprising a light emitter inside an outer envelope are known per se and include, for example, ancient and well known incandescent light sources. These incandescent light sources are still used extensively as they are relatively easy to manufacture and because many optical systems of, for example, luminaires are designed and optimized to use the light distribution coming from these incandescent light sources. A well known drawback of the incandescent light sources is that they have a relatively low efficiency as they emit a large part of their energy in the infrared part of the electromagnetic spectrum. As such, many replacement light sources have been developed for replacing the incandescent light sources, for example, the compact fluorescent light sources, and, more recently, light sources comprising light emitting diode devices. These replacement light sources clearly have improved efficiency compared to incandescent light sources.

An example of a retrofit lamp comprising light emitting diode devices as light emitter may be found in the non-prepublished patent application "Illumination device with LED and a transmissive support comprising a luminescent material" of the current applicant, attorney docket PH009408, incorporated herein by reference. In the embodiment shown in FIG. 3 of the cited patent application the retrofit lamp is shown in which a light emitting diode is arranged inside a transmissive support which again is arranged inside a translucent exit window. A disadvantage of the above-mentioned retrofit lamp is that the emission profile in a plane perpendicular to the base of the LED is not wide enough.

SUMMARY OF THE INVENTION

It is an object of the invention to provide a light source with an increased emission profile.

According to an aspect of the invention the object is achieved with a light source comprising a light emitter arranged inside a translucent outer envelope, the light emitter comprising a light emitting device and comprising a translucent inner envelope at least partially surrounding the light emitting device, the translucent inner envelope comprising a diffuser for diffusing at least a part of the light emitted by the light emitting device, a diameter of the translucent inner envelope being smaller than a diameter of the translucent outer envelope, the translucent outer envelope being connected to a base, and further comprising a symmetry axis, an imaginary base-plane being defined substantially perpendicular to the symmetry axis and intersecting with a connection point being a light transmitting part of the translucent outer envelope at an interface between the translucent outer envelope and the base at a furthest distance from a center of the translucent outer envelope, the light emitter being arranged inside the translucent outer envelope at a distance from the imaginary base-plane away from the base.

A difference between the light source according to the invention and the retrofit lamp as shown in FIG. 3 of the cited non-prepublished patent application is that the light emitter is arranged inside the outer envelope at a distance from the imaginary base-plane away from the base. As the light emitter comprises both the light emitting device and the translucent inner envelope, the distance between the light emitter and the base-plane indicates a distance from the base-plane to, for example, the bottom of the translucent inner envelope. The translucent inner envelope does not intersect with the base-plane but is fully positioned at a distance from the base-plane.

An effect of the light source according to the invention is that the spatial emission profile of the light source according to the invention is increased. Because the light emitter according to the invention comprises the translucent inner envelope comprising the diffuser, and because the light emitter is positioned at a distance from the imaginary base-plane, more light is emitted in a direction towards the imaginary base-plane, thus increasing the spatial emission profile of the light source according to the invention compared to the retrofit lamp as shown in FIG. 3 of the cited non-prepublished patent application.

The emission profile of a light source having a symmetry axis is typically defined as an angular distribution of the light in a plane intersecting with the symmetry axis, further also indicated as distribution plane. In the current document this angular distribution is defined using a Full Width at Half Maximum value (further also indicated as FWHM value) of the intensity as measured around the light source in the distribution plane. In the retrofit lamp according to the cited non-prepublished patent application the angular distribution using this FWHM definition in the distribution plane would be less than 180 degrees. This is due to the fact that the light emitting diodes typically emit a Lambertian light distribution which covers at half the intensity less than 180 degrees. When using such a lamp from the non-prepublished patent application as retrofit lamp in a luminaire comprising an optical system optimized for known incandescent light sources, the emission characteristic of the luminaire comprising this retrofit lamp would typically be different as the angular distribution of the retrofit lamp according to the non-prepublished patent application differs too much from the angular distribution of the incandescent light source. In the light source according to the invention, the inner envelope comprises a diffuser and is located at a distance from the imaginary base-plane which generates a larger light flux towards the imaginary base-plane from the inner envelope, which may be used to increase the spatial emission profile typically to a value well above 180 degrees FWHM in the distribution plane. By carefully selecting the diffusivity of the diffuser of the inner envelope and by carefully selecting a location of the inner envelope inside the outer envelope, an emission profile may be generated of the light source according to the invention which closely resembles the emission profile of well known incandescent light sources. The diffusivity of the diffuser is determined by measuring a scattering behavior of a collimated pencil beam impinging on the diffuser and resulting in a spatial scattering of the impinging collimated pencil beam. The impinging collimated pencil beam typically comprises a divergence FWHM of less than one degree. As such, when using the light source according to the invention in the luminaire comprising the optical system optimized for known incandescent light sources, the emission characteristic of this luminaire with the light source according to the invention would be substantially similar to the emission characteristic when the incandescent light source is used.

A further benefit of the light source according to the invention is that the single light emitter inside the outer envelope at a distance from the base may be used to generate an appearance of the light source—during operation—as if the light source would comprise a filament. This specific appearance of the light source according to the invention is further indicated as the filament effect. In incandescent light sources, the filament emits light from a location with a very high brightness. As the human eye is not able to handle such high brightness coming from a relatively small location (being the filament), this filament inside the known incandescent light sources is observed by the human eye as a glowing volume larger than the filament inside a glass envelope. By applying the inner envelope at substantially the same location as where the glowing sphere is perceived in an incandescent light source, the appearance, in operation, of an incandescent light source by the light source according to the invention may be very well imitated. Especially in optical designs where the location of the filament in the incandescent light source is important, the light source according to the invention may be used as a retrofit lamp having substantially similar characteristics as the incandescent light source while being much more energy efficient, especially when light emitting diodes are used as light emitting device. Due to the filament effect, the emission of the light source according to the invention closely resembles the emission of the incandescent light source, both in spatial emission profile and in appearance.

In an embodiment of the light source, the diffuser comprises luminescent material and/or the diffuser is constituted of luminescent material. The luminescent material is configured for converting light emitted by the light emitting device into light of a longer wavelength. Typically not all of the impinging light is converted by the luminescent material. The converted light is typically emitted in all directions, so the luminescent material acts as a diffuser for the converted light. In addition, luminescent materials also often diffuse part of the light which is transmitted or reflected by the luminescent material. So in one embodiment the inner envelope comprises both a diffuser and luminescent material. In another embodiment, the inner envelope may comprise only luminescent material which also acts as a diffuser. Alternatively the inner envelope may be constituted completely of luminescent material, for example, when the luminescent material is a self-supporting material from which the inner envelope may be manufactured. A first part of the light impinging on the inner envelope will be absorbed by the luminescent material and part of the absorbed light will be converted into light of a larger wavelength. How much of the absorbed light will be converted into light of the larger wavelength depends, amongst other on the quantum efficiency of the luminescent material, on the total phosphor load per unit area and on the diffusing properties of the diffuser. A second part of the light impinging on the inner envelope will be diffused, either by reflection and diffusion from the luminescent material or by reflection and diffusion from other diffuser material which may be mixed with the luminescent material or which may be applied to the inner envelope on a different layer compared to the luminescent material. A third part of the light impinging on the inner envelope may be transmitted by the inner envelope without being diffused or changed.

The diffuser may be applied as a layer on the inner or outer wall of the inner envelope. Alternatively, the diffuser may be embedded in the material constituting the inner envelope, for example, the material constituting the inner envelope may have scattering particles embedded in the material before the inner envelope is manufactured from the material.

Also the luminescent material may be applied as a layer on the inner wall or outer wall of the inner envelope. And also the luminescent material may be embedded in the material which constitutes the inner envelope. The luminescent material may comprise a single luminescent material which converts the impinging light of the light emitting device into light of a longer wavelength. Alternatively, the luminescent material may comprise a mixture of different luminescent materials absorbing light of the same or different color and converting the absorbed light into light of longer wavelength having different colors. Alternatively, the luminescent material may comprise a mixture of different luminescent materials, where the luminescent materials have different spectral absorption and excitation properties (i.e. they are excited differently upon irradiation with light of different pump wavelengths), and the light source may emit light of two substantially different colors. The different luminescent materials may alternatively be applied in layers applied on top of each other. In a mixture of luminescent materials, some light emitted by one of the luminescent materials from the mixture may be partially absorbed by a different luminescent material which converts this absorbed light again in light having a longer wavelength. In such an embodiment, the light emitter may, for example, emit light of the color blue while a first luminescent material may absorb part of the light of the color blue and convert part of the absorbed light into light of the color green. A second luminescent material mixed with the first or applied in a layer on the first luminescent material may absorb part of the light of the color green and convert part of the absorbed light into light of the color red. By choosing an appropriate mixture or appropriate layer thickness of the first and second luminescent materials, the light source may emit light of a specific color. This color may be tuned by tuning the concentration of the different luminescent materials in the mixture or by tuning the thickness of the layers of the luminescent materials or by tuning the spectral emission of the light source.

In this context, light of a specific color, for example, the color red or green, typically comprises light having a predefined spectrum. The predefined spectrum of the specific color may comprise light contributions having a specific bandwidth around a central wavelength which is perceived as light of the specific color. The predefined spectrum may also be constituted of a plurality of narrow spectra in which the central wavelength may be defined as the wavelength of the perceived color of the plurality of narrow spectra. The central wavelength is a mean wavelength of a radiant power spectral distribution. In this context, light of a predefined color also includes non-visible light, such as ultraviolet light and infrared light. The term "primary color" is typically used for light which is used to be mixed such that substantially every color can be generated. The primary colors, for example, include red, green, blue, yellow, amber, and magenta. Light of the specific color may also comprise mixtures of primary colors, such as blue and amber, or blue, yellow and red, or blue, green and red. The specific color may, for example, be constituted of a specific combination of the red, green and blue light. Light of a specific color also includes white light and includes different types of white light which is typically indicated as white light having a specific color temperature. The number of primary colors used to generate the specific color may vary.

In an embodiment of the light source, the light emitting device is a light emitting diode and/or a light emitting laser diode. A benefit of this embodiment is that the energy efficiency of the light emitting diode is relatively high, making the light source a very efficient light source. The light emitting diode and/or light emitting laser diode may comprise phosphor converted light emitting diodes and/or phosphor converted light emitting laser diodes.

In an embodiment of the light source, the light emitting device is arranged on a substantially flat circuit board arranged substantially parallel to the imaginary base-plane. A benefit of this embodiment is that the circuit board is relatively easy to manufacture. When placing the substantially flat circuit board in the light emitter according to the invention the light spatial distribution of the light source still is relatively large. Other light sources are known comprising light emitting diodes and which are configured for replacing incandescent light sources. Such light sources are, for example, known from US 2003/0039120. In this known light source from US 2003/0039120 a plurality of light emitting diodes are used to improve the light distribution. These plurality of light emitting diodes in this known light source are arranged at different angles with respect to each other which is relatively difficult to produce as these different light sources may not be placed on a single circuit board but have to be placed on multiple circuit boards which preferably interconnect to provide power from a single power source. Furthermore, as the rear sides of the plurality of light sources are pointed to the center of the known light source disclosed in US 2003/0039120, cooling of the plurality of light sources is an issue. In the light source according to the invention, a single circuit board comprises the light emitting diode while due to the diffuser of the inner envelope and due to the distance between the inner envelope and the imaginary base-plane, the angular distribution of the light source according to the invention may be generated which closely resembles the emission distribution of incandescent light sources.

In an embodiment of the light source, the light source comprises a plurality of light emitting devices arranged on a plurality of circuit boards arranged at different angles with respect to the symmetry axis and/or with respect to each other. This may further enhance the beam width.

In an embodiment of the light source, an optical element is arranged inside the inner envelope for generating a batwing or a butterfly shaped radiation profile from the light emitting device when viewed in a cross-sectional view through the symmetry axis to enhance a relative level of radiation on the inner envelope at portions away from the top of the inner envelope, the top of the inner envelope being the part of the inner envelope intersecting with the symmetry axis. Such optical elements are known and in combination with the current light source would further increase the beam diameter and would improve the color over angle emitted by the light source.

In an embodiment of the light source, a diameter of the inner envelope is smaller than or equal to 70% of the diameter of the outer envelope, and/or wherein the diameter of the inner envelope is smaller than or equal to 50% of the diameter of the outer envelope, and/or wherein the diameter of the inner envelope is smaller than or equal to 40% of the diameter of the outer envelope. When the diameter is approximately 70% or less of the diameter of the outer envelope the light source, in operation, resembles the aesthetic appearance of a well known incandescent lamp, also indicated as the filament effect. This resembling of the appearance of the well known incandescent lamp has a technical advantage in that many optical systems have been designed for a light source having a glowing filament at a predefined location inside an envelope. Due to the filament effect in the light source according to the invention, the light source according to the invention may substantially immediately replace incandescent lamps in substantially all optical systems without the need for redesigning the optical system. To best resemble the filament effect, the diameter of the inner envelope is as small as possible. However, when using relatively small diameter of the inner envelope, a temperature rise of the inner envelope due to the presence of the light emitting diode may be significant such that the luminescent material of the inner envelope may degrade due to thermal quenching and/or such that the non-luminescent material of the inner envelope may degrade due to thermal or opto-thermal effects. Furthermore, the high light flux density on the luminescent material due to the relatively small diameter may also degrade the luminescent material. As such, an optimal diameter of the inner envelope may be found in which the filament effect is achieved to a sufficient extent while limiting the temperature rise of the luminescent material.

In an embodiment of the light source, the inner envelope comprises a cut-out portion for accommodating the light emitting device, and a diameter of the inner envelope is larger than a diameter of the cut-out portion. The diameter of the inner envelope is measured in a direction parallel to the direction for measuring the diameter of the cut-out portion. In such an arrangement, the inner envelope extends outward at the intersection between the inner envelope and the circuit board comprising the light emitting device. This initial extension of the inner envelope causes part of the diffusing envelope to substantially face the imaginary base-plane ensuring that a larger part of the light of the light emitting device diffused by the diffuser is emitted towards the connection point, thus increasing the light energy which is emitted toward the connection point, thus further increasing the width of the emitted light distribution.

In an embodiment of the light source, the inner envelope comprises a full spherical shape or a partial spherical shape. A benefit of this embodiment is that the spherical shape closely resembles the perceived shape of the glowing filament in the known incandescent lamp. Furthermore, the spherical shape is relatively easy to manufacture and constitutes a relatively strong mechanical structure. The inner envelope may have a partial spherical shape when part of the spherical shape of the inner envelope has been removed due to, for example, the cut-out portion, for example, for accommodating the light emitting device.

In an embodiment of the light source, the inner envelope has a larger dimension in a direction parallel to the symmetry axis compared to a dimension in a direction perpendicular to the symmetry axis. Such an inner envelope results in a different filament effect compared to the previous embodiments in which the inner envelope comprises a substantially spherical shape.

In an embodiment of the light source, the inner envelope and/or the outer envelope comprise an at least partially reflective layer. Such at least partially reflective layer may reflect light impinging, for example, near the intersection point between the outer envelope and the symmetry axis and reflects at least part of this light back towards the base-plane and as such increase the spatial emission profile of the light source according to the invention.

In an embodiment of the light source, the at least partially reflective layer is arranged on a part of the inner envelope and/or on a part of the outer envelope. For example, the top part of the inner envelope or outer envelope may comprise an area having the at least partially reflective layer. Such a reflective area would clearly reflect light back and increase the spatial emission profile. The top part of the inner envelope and the outer envelope are respective parts of the inner envelope and outer envelope intersecting with the symmetry axis.

In an embodiment of the light source, the light emitter is arranged on a connection element for connecting the light emitter to the base and for defining the distance between the light emitter and the imaginary base-plane. The connection element may be used for ease of manufacturing to define the position of the light emitter inside the outer envelope. As the light emitter typically does not emit light through the circuit board comprising the light emitting device, the arrangement of the connection element between the base and the circuit board does not obstruct the emission of light and the emission distribution of the light source according to the invention.

In an embodiment of the light source, the distance between the light emitter and the imaginary base-plane is chosen to generate an emission distribution in a distribution plane of at least 220 degrees full width at half maximum and/or of at least 250 degrees full width at half maximum, the distribution plane being an imaginary plane intersecting with the symmetry axis. The distribution plane may, for example, be the cross-sectional plane as shown in FIG. 4B, or may be any other plane intersecting with the symmetry axis. The emission distribution of the light source according to the invention typically is substantially rotational symmetric around the symmetry axis—slight deviation from the rotational symmetry may be caused due to the presence of more than one light emitting device inside the light emitter. Thus by defining the emission distribution in the distribution plane enables a relatively simple two-dimensional representation defining the emission distribution of the light source in three dimensions.

In an embodiment of the light source, the connection element is a cone-shaped connection element widening from the light emitter towards the base for preventing light emitted by the light emitter toward the connection point to be obstructed by the connection element. The use of the cone-shaped connection element allows that light emitted by the light emitter towards the connection point to also reach the connection point and as such increase the width of the light distribution emitted by the light source according to the invention. Especially in combination with the spherical cap shaped inner envelope in which the cut-out portion is smaller than the diameter of the inner envelope, the cone-shaped connection element allows light emitted by the spherical cap shaped inner envelope to be emitted towards the connection point thus improving the light distribution emitted from the light source according to the invention. So the width of the cone should preferably not exceed the connection point. Still the use of the cone has a further benefit that it defines within which space additional electronic circuitry may be added to the light source according to the invention without obstructing the light emitted from the light emitter. Typically power conversion electronics and drive electronics for driving the light emitting devices such as light emitting diodes are required in the light source according to the invention. As the outer dimensions of the light source also preferably resembles the outer dimensions of the incandescent light source which has to be replaced, only little space is left for these additional circuits. The inside of the cone-shaped connection element provides valuable space for these circuits.

In an embodiment of the light source, the connection element is thermally connected to the light emitting device for extracting heat away from the light emitting device. Light emitting devices typically produce heat which must be guided away from the light emitting device to prevent it from overheating. Especially when using light emitting diodes, the heat regulation is essential to ensure that the light emitting device operates efficiently. Guidance of the produced heat via the connection element to the base where it may be connected to further cooling means may thus be beneficial to the light source according to the invention.

In an embodiment of the light source, the base further comprises a heat transfer means being thermally connected to the connection element. Such a heat transfer means may, for example, be a heat sink and/or cooling fins for guiding the heat towards ambient. The heat transfer means may also comprise other cooling means, for example, heat exchange means for exchanging heat with a fluid such as a cooling liquid.

In an embodiment of the light source, the heat transfer means comprises cooling fins extending in a direction parallel to the symmetry axis for allowing light to be emitted from the outer envelope through the gaps between the cooling fins. A width of the cooling fins in a direction perpendicular to the symmetry axis near the connection element may be larger than the width of the connection element near the base which may be used to improve the flow of air along the cooling fins. As these cooling fins may obstruct light from being emitted from the light source, the cooling fins are arranged parallel to the symmetry axis which enables light emitted from the light emitter to be emitted through the gaps between the cooling fins. This would reduce a possible obstruction by the cooling fins to a minimum. The connection point as defined in claim 1 may be located in between two cooling fins as it represents a light transmitting part of the outer envelope at the intersection between the outer envelope and the base located at a furthest distance from the center of the outer envelope. As such, this location may clearly be located between two cooling fins when the cooling fins extend in radial direction up to or outside the outer envelope. The light distribution at the gaps between the cooling fins may be sufficient to improve the light emission distribution compared to the known replacement lamps for incandescent light sources.

In an embodiment of the light source, the outer envelope comprises a further diffuser for diffusing light transmitted through the outer envelope. This further diffuser at the outer envelope operates in two ways: first it further diffuses the light originating from the inner envelope to further enhance the spatial distribution of the light emitted by the light source thus enhancing the emission distribution of the light source. On the other hand, this further diffuser diffuses light from ambient which impinges on the outer envelope, and at the same time diffuses the light from ambient that is transmitted through the outer envelope and which impinges on the inner envelope and that is subsequently reflected or scattered away from the inner envelope via the outer envelope again. As such, the inner envelope will be only vaguely visible from the outside, obstructing and diffusing the color of the inner envelope. This reduces a color appearance of the light source when observed in the off-state. The inner envelope may comprise luminescent material. When using, for example, light emitting diodes emitting light of a color blue, the color of the light emitted by the luminescent material of the inner envelope to produce substantially white light is light of the color yellow. Such luminescent material has a yellow appearance also in the off state. As such, the color appearance of the light source comprising the inner envelope comprising luminescent material emitting light of the color yellow typically is yellow, which may confuse customers buying such a light source. The light source appears yellow, while the light emitted in the on-state of the light source is substantially white. To avoid such confusion at the customers, the outer envelope comprises the further diffuser which only allows the inner envelope to be vaguely visible thus reducing the yellow appearance of the light source according to the invention.

In an embodiment of the light source, the further diffuser comprises a diffusivity between 5 and 120 degrees Full Width at Half Maximum, the diffusivity being defined by a scattering behavior of a collimated pencil beam impinging on the diffuser and resulting in a spatial scattering of the impinging collimated pencil beam. The impinging collimated pencil beam typically comprises a divergence FWHM of less than one degree. In this context, light that is not diffused more than 5 degrees is regarded as substantially unaltered and is therefore regarded as not-diffused.

In an embodiment of the light source, a wall of the inner envelope facing the outer envelope comprises a diffusing layer. By additionally applying the diffusing layer on the outer layer of the inner envelope, the appearance of the inner envelope in the off-state may be altered. When the diffusing layer comprises a white diffusing layer, the color appearance of the inner envelope may be substantially white, thus avoiding any customer confusion when looking at the light source according to the invention. The diffusing layer may comprise, for example, $TiO_2$, or $SiO_2$, or $Al_2O_3$ which typically results in a white appearance when irradiated with white light. The light emitting device often emits light of the color blue of which part is converted by the luminescent material on the inner envelope into light of the color yellow. Mixing the blue light with the yellow light may result in white light. Still the luminescent material emitting yellow light often also has a yellow appearance. As such, the inner envelope may have a yellow appearance which may confuse customers when looking at the light source in the off-state in that they may think the light source will emit yellow light also in the on-state. Now by adding the diffusing layer on the outer wall of the inner envelope, the appearance of the inner envelope in the off-state may be determined. When the diffusing layer comprises the white diffusing layer on the outer layer of the inner envelope, the appearance of the light source is substantially less saturated, i.e. less colored, avoiding confusion at the customer buying the light source.

In an embodiment of the light source, the light source further comprises a surface comprising the light emitting device, the surface comprising a reflective layer and/or comprising further luminescent material. A benefit of this embodiment is that the presence of the reflective layer enhances light recycling and improves the efficiency of the light source. Furthermore, when having a surface absorbing the impinging light, the temperature of the surface comprising the light emitting device may rise, which is not preferred. When applying the further luminescent material on the surface, additional light conversion may be possible, for example, to enhance the color conversion or to fine-tune the color emitted by the light source to better correspond to the required color. The further luminescent material may also be used to correct any color variation present in the light emitting device. Especially the color of the light emitted by light emitting diodes may differ in different production batches of the light emitting diode. Applying a specific further luminescent material or by applying a specific mixture of further luminescent materials on the printed circuit board comprising the light emitting diodes, color variations between light emitting diodes may be compensated.

In an embodiment of the light source, the light source further comprises a reflective layer and/or further luminescent material applied to non-translucent surfaces inside the outer envelope. A benefit of this embodiment is that by using substantially all non-translucent surfaces, more reflection and/or luminescent surfaces may be generated, allowing further improved efficiency. Another benefit of this embodiment is that it enables tuning of the beam width (i.e. the FWHM). In addition, this embodiment enables minimization of the variation in color of the azimuthal angular distribution of the light.

In an embodiment of the light source, the light emitting device comprises a plurality of light emitting diodes arranged at different angles with respect to the symmetry axis and/or with respect to each other. Although the use of light emitting diodes arranged at different angles typically results in a relatively expensive printed circuit board, it allows actively adapting the emission distribution of the light source according to the invention. Using the diffusing inner envelope within which the light emitting devices emit their light will average these emission distributions into a relatively smooth emission distribution.

In an embodiment of the light source, the light emitting device comprises a phosphor-enhanced light emitting device. Phosphor-enhanced light sources are widely used and may very well be applied in the light source according to the invention.

In an embodiment of the light source, the light emitting device is configured for emitting light of the color blue and wherein the inner envelope comprises luminescent material configured for absorbing light of the color blue and converting part of the absorbed light into light of the color yellow. By choosing the concentration of luminescent material inside the light source, the color of the light emitted by the light source may be determined White light may be generated by combining blue light and yellow light.

In an embodiment of the light source, the light emitting device is configured for emitting light of the color blue and light of the color red-orange, and wherein the inner envelope comprises luminescent material configured for absorbing light of the color blue and converting part of the absorbed light into light of the color yellow-green. The light emitting device emitting red-orange light may be, for example, a phosphor-enhanced light emitting diode device that may or may not also emit light of the color blue, or a light emitting diode device that intrinsically emits red-orange light.

In an embodiment of the light source, a wall of the outer envelope facing the inner envelope comprises an even further luminescent layer for converting light emitted by the light emitter into light of a longer wavelength. This even further luminescent layer may also act as the diffusing layer applied to the outer envelope.

In an embodiment of the light source, a wall of the outer envelope facing the inner envelope comprises an organic lumophor layer for converting light emitted by the light emitter into light of a longer wavelength. A benefit when using a lumophor layer is that the lumophor layer substantially has no scattering which further enhances the efficiency of the system. Any scattering in the light source leads to some loss of light. Having a light conversion layer without scattering would reduce the scattering losses and would thus improve the efficiency. A further benefit of organic lumophor material is that the lumophor may be chosen to have a relatively small Stokes-shift. The inventors have found that when using an organic lumophor material which converts light while having a Stokes-shift below 150 nanometers or, more preferably, below 100 nanometers, the emission spectrum of the light emitted by the lumophor material remains narrow, and the emission spectrum of the light source is prevented from expanding into the deep-red range of the spectrum. As the lumophor material typically is used to contribute light having the color red, the limitation of the emission spectrum enables to limit the infrared contribution of the organic lumophor material and as such ensure good efficiency. In such a light source a first luminescent material may, for example, convert the blue light from the light emitting device into green light, and the lumophor material may convert part of the green light into red light. Other color combinations may be chosen without departing from the scope of the invention.

BRIEF DESCRIPTION OF THE DRAWINGS

These and other aspects of the invention are apparent from and will be elucidated with reference to the embodiments described hereinafter.

In the drawings.

The figures are purely diagrammatic and not drawn to scale. Particularly for clarity, some dimensions are exaggerated strongly. Similar components in the figures are denoted by the same reference numerals as much as possible.

DETAILED DESCRIPTION OF EMBODIMENTS

Figure 1:
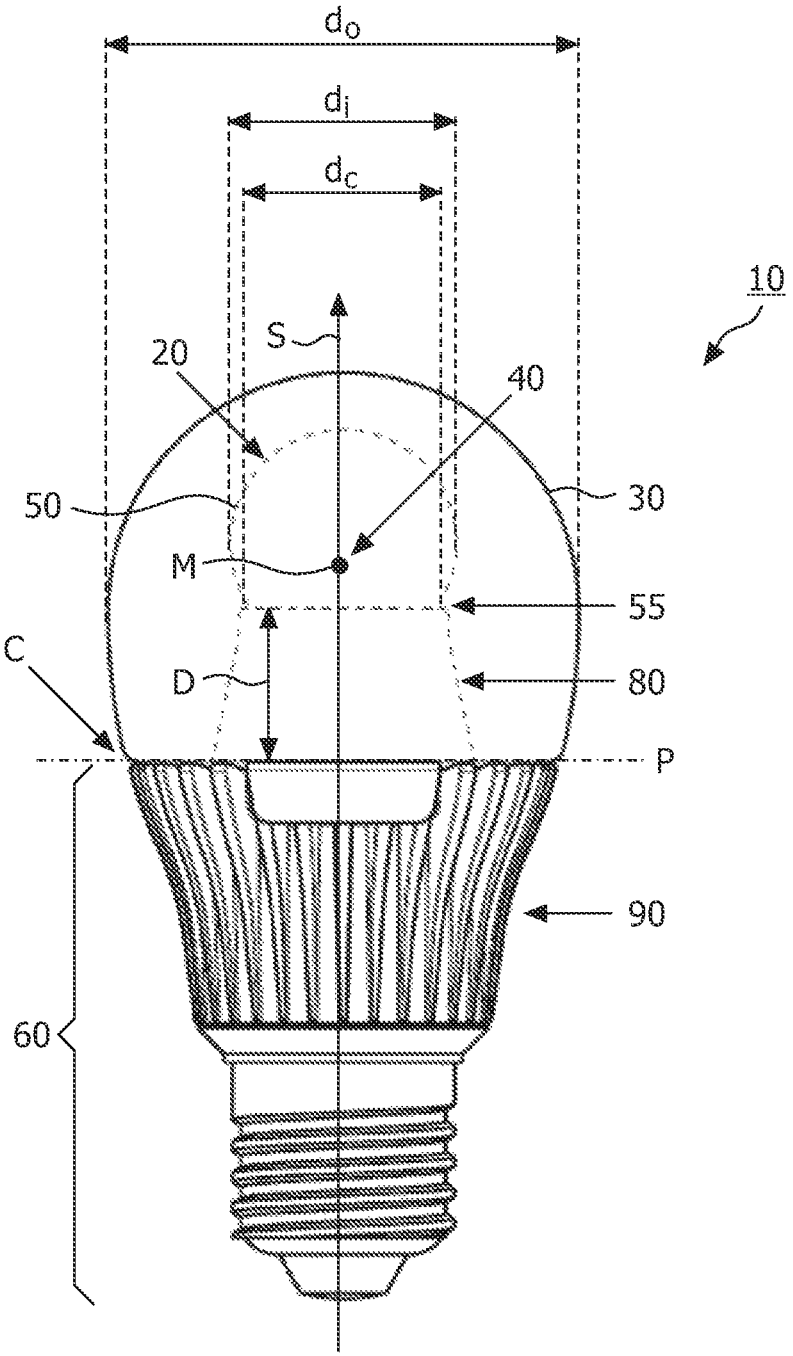
FIG. 1 shows a side-view of a light source according to the invention.

FIG. 1 shows a side-view of a light source 10 according to the invention. The light source 10 comprises a light emitter 20 which is positioned inside a translucent outer envelope 30. The light emitter 20 comprises a light emitting device 40 (see FIG. 4) which is at least partially surrounded by a translucent inner envelope 50 comprising a diffuser (not indicated) for diffusing at least a part of the light emitted by the light emitting device 40. The diffuser may be integrated in the wall of the inner envelope 50 or may be applied as a layer to an inner wall or an outer wall of the inner envelope 50. A diameter $d_i$ of the translucent inner envelope 50 is smaller than a diameter $d_o$ of the translucent outer envelope 30. The translucent outer envelope 30 is connected to a base 60 which is usually not translucent. Furthermore, the translucent outer envelope 30 comprises a symmetry axis S. In FIG. 1 also an imaginary base-plane P is indicated via a dash-dotted line. This imaginary base-plane P is defined substantially perpendicular to the symmetry axis S and intersects with a connection point C which is part of the translucent outer envelope 30. The connection point C being a light transmitting part of the translucent outer envelope 30 at an interface between the translucent outer envelope 30 and the base 60 at a furthest distance from a center M of the translucent outer envelope 30. The exact location of the center M of the translucent outer envelope 30 is not required as it only is used to define a direction in which the furthest distance has to be found.

The light emitter 20 is positioned inside the translucent outer envelope 30 at a distance D from the imaginary base-plane P away from the base 60.

The imaginary base-plane P defines a rim which physically blocks light which is emitted by the light emitter inside the outer envelope. As the imaginary plane intersects with the connection point C which is defined as a translucent point nearest to the base, the connection point is the closest point to the base which still emits light. By defining a distance between the light emitter and the base via the imaginary base-plane P, the point at which the increase of the emission distribution commences compared to the embodiment shown in the non-prepublished patent application as cited in the introductory part is defined.

An effect of the light source 10 according to the invention is that the emission profile (see FIG. 2) of the light source 10 according to the invention is increased. Because the light emitter 20 according to the invention comprises the translucent inner envelope 50 comprising the diffuser, and because the light emitter 20 is positioned at the distance D from the imaginary base-plane P, more light is emitted in a direction towards the imaginary base-plane P, thus increasing the emission profile of the light source 10 in a direction towards the imaginary base-plane P. Generally each scattering point in a diffuser causes part of the impinging light to be scattered substantially in multiple directions, and in case of isotropic scattering even in all directions. "Elevating" this diffuse light emitter 20 from the base 60 will increase the angles at which light is emitted from the light source 10 and as such increases the emission profile.

When the distance D between the light emitter 20 and the imaginary base-plane P would be zero, no "elevation" of the light emitter 20 would be present and the rim of the base 60 will block a substantial part of the light from being emitted by the light source 10 at angles larger than 90 degrees from a direction along the symmetry axis S pointing away from the base towards the outer envelope, which corresponds with an emission distribution that is not substantially larger than 180 degrees. In such an embodiment, substantially no light will be emitted towards the imaginary base-plane P. By positioning the light emitter 20 at the distance D from the imaginary base-plane P, the scattered light from the diffuser of the inner envelope 50 will ensure that a larger contribution of scattered light will be emitted towards the imaginary base-plane P, thus increasing the emission distribution to above 180 degrees.

A further benefit of the light source 10 according to the invention is that the light emitter 20 inside the outer envelope 30 at the distance D from the base 60 may be used to generate an appearance of the light source 10—during operation—as if the light source 10 would comprise a filament. In incandescent light sources, the filament emits very high intensity light. As the human eye is not able to handle such high intensities, this filament inside the known incandescent light sources is often observed by the human eye as a glowing sphere inside a glass envelope. By applying the inner envelope 20 at substantially the same location as where the glowing sphere is perceived in an incandescent light source, the appearance, in operation, of an incandescent light source by the light source 10 according to the invention may be very well imitated. This may be especially beneficial in optical designs where the location of the filament in the incandescent light source is important. The light source 10 according to the invention may directly be used as a retrofit lamp having substantially similar characteristics as the incandescent light source while being much more energy efficient, especially when light emitting diodes 40 (see FIG. 4) are used as light emitting device 40.

The distance D between the base and the light emitter 20 may be chosen such that the beam width is at least 220 degrees FWHM. This typically results in that the center of gravity of the inner envelope 50 is located at a position between ¼ of a height of the outer envelope 30 relative to the base 60 of the light source 10, and ¾ of the height of the outer envelope 30, preferably between ⅓ of a height of the outer envelope 30 relative to the base 60 of the light source 10, and ⅔ of the height of the outer envelope 30. The height of the outer envelope 30 is measured in a direction of the symmetry axis S.

The geometry of the components is chosen such that the beam width is at least 220 degrees FWHM. This may be achieved by selecting a geometry of the components in which an angle between a line (not indicated) connecting the point on the surface of the inner envelope at the maximum diameter of the inner envelope and the connection point C, and the symmetry axis S should be smaller than 90 degrees, preferably smaller than 45 degrees, preferably smaller than 30 degrees. In the embodiment shown in FIG. 1 the angle defined in the previous line is approximately 25 degrees, and this lamp results in a beam angle of about 250 degrees FWHM. In addition, the diffusivity of the inner envelope 20 preferably is high, preferably FWHM larger than 80 degrees.

The inner envelope 20 comprises a cut-out portion 55 for accommodating the light emitting device 40. In the embodiment shown in FIG. 1, the cut-out portion 55 is formed as a planar cut through a spherical inner envelope 20. Of course, also other shapes of the cut-out portion 55 may be possible. A diameter $d_i$ of the inner envelope 20 is larger than a diameter $d_e$ of the cut-out portion 55. As a result, the inner envelope 20 bulges outward at the intersection between the inner envelope 20 and the circuit board 70 (see FIG. 4B) which comprises the light emitting device 40. This initial extension of the inner envelope 20 causes part of the diffuser at the inner envelope 20 to substantially face the imaginary base-plane P. As such, more light will be scattered towards the imaginary base-plane P thus ensuring that a larger part of the light of the light emitting device 10 is emitted towards the imaginary base-plane P. As such the emission distribution of the light source 10 may be further enhanced.

Although the inner envelope 20 in the embodiments of the light source 10, 12 all have a spherical shape, the inner envelope 20 may, of course have any shape. The benefit of this spherical shape is that the glowing filament at relatively high intensity is also perceived as a glowing spherical ball and thus using this spherical inner envelope 20 may cause the light source in operation to closely resemble incandescent light sources.

The light emitter 20 is positioned inside the outer envelope 30 via the connection means 80. The connection means 80 may of course have any shape. However, the connection means 80 may preferably have a hollow cone-shape which expands from the circuit board 70 on which the light emitting device 40 is connected towards the base. The width of the cone-shaped connection means 80 preferably is smaller than the diameter of the base 60 such that no light emitted by the light emitter 20 is blocked by the connection means 80. Inside the hollow cone-shaped connection means 80 additional electronics may be located for converting power to a suitable level for the used light emitting device 40 and may comprises specific electronics for driving the light emitting device. 40. Finally, the connection means 80 may have a heat-conductive function. When using light emitting diodes 40 as light emitting devices 40, the cooling of the light emitting diodes 40 is an important issue. Inside the light emitter 20 there is no space to have cooling means for reducing and/or limiting the temperature of the light emitting devices 40 inside the light emitter 20. When using the connection means 80, the connection means 80 may be used to conduct the heat away from the light emitting devices 40, for example, towards the base 60 where additional heat transfer means 90 may be present.

The base 60 is connected to the outer envelope 30. This base 60 comprises the heat transfer means 90 which in the current embodiment are constituted of cooling fins 90 which conduct the heat from the light emitting devices 40 via the connection means 80 to the environment. As mentioned before, also other heat transfer means 90 may be used such as heat exchangers (not shown) which exchange heat with a cooling fluid, for example, a cooling liquid. The base 60 as shown in FIG. 1 also comprises a winding similar to the windings used for connecting the known incandescent light sources to an external power source (not shown). As such the light source 10 may directly be used as retrofit for the well known incandescent light sources having such similar winding. Of course also other means for connecting the light source 10 to some external power source may be used.

Figure 2:
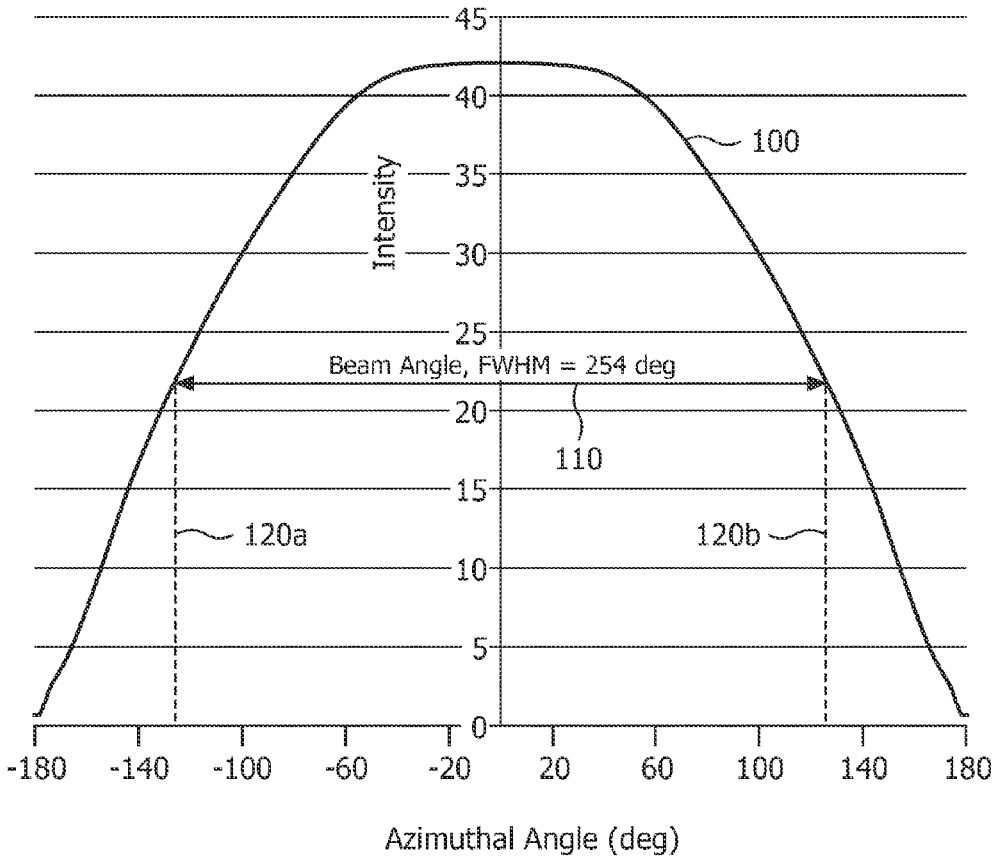
FIG. 2 shows a graph indicating the emission distribution of the light source according to the invention.

FIG. 2 shows a graph indicating the emission distribution of the light source 10 according to the invention shown in FIG. 1. In the graph shown in FIG. 2 the intensity of the light is plotted along the vertical axis of the graph and the azimuthal angle along the horizontal axis. The width of the beam is defined at half the maximum intensity as is indicated with the double arrow 110 in the center of the light intensity curve 100. The dashed lines 120*a*, 120*b* originating from the intersection point between the double arrow 110 and the light intensity curve 100 define the angular distribution of the light source 10 at full width at half maximum. In the current example the width of the emission distribution of the light source 10 is 254 degrees FWHM for a light source 10 having a distance D (see FIG. 1) between the base 60 and the light emitter 20 of 16.5 millimeter. This is equivalent with a position of the center of gravity of the inner envelope 50 of ½ the height of the outer envelope 30.

Figure 3B:
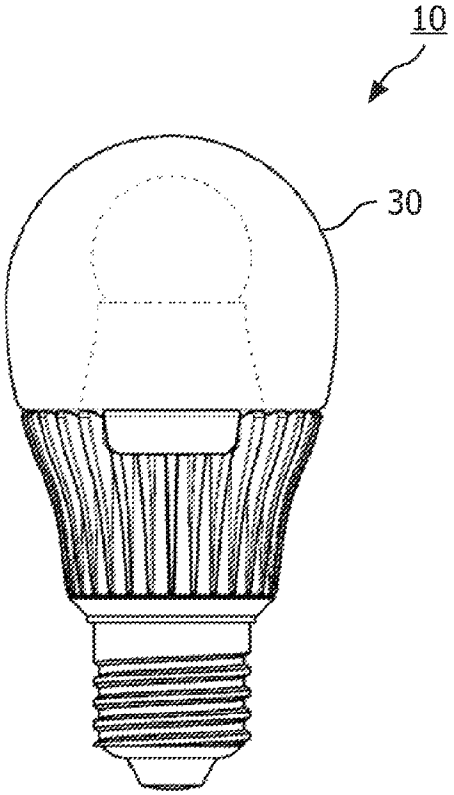
FIGS. 3A and 3B show side views of different embodiments of the light source according to the invention.
Figure 3A:
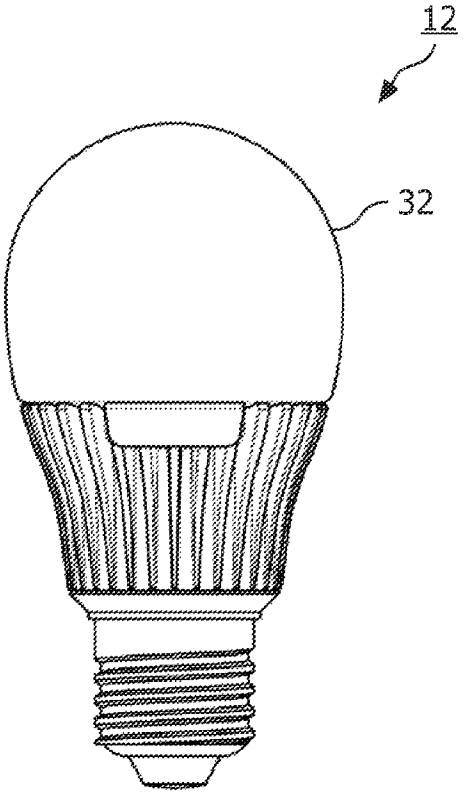

FIGS. 3A and 3B show side views of different embodiments of the light source 10, 12 according to the invention. In the different embodiments shown in FIGS. 3A and 3B the outer envelope 30, 32 comprises a further diffuser. The further diffuser is configured for redirecting part of the light transmitted by the outer envelope 30, 32. The diffuser comprises a predefined diffusivity which influences the appearance of the light source 10, 12 according to the invention. The diffusivity is defined by scattering behavior of a collimated pencil beam using the parameter Full Width at Half Maximum of the transmitted beam. The collimated pencil beam comprises a FWHM of the collimated beam of less than 1 degree. The FWHM can be between 5 and 120 degrees. Preferably the diffusivity is between 5 and 40 degrees in order to have some additional redirecting, have the filament effect, and still have a high efficiency. In FIG. 3A the diffusivity is highest which results in the details of the inner envelope 50 are hardly visible. As the inner envelope 50 typically comprises a luminescent material converting blue light into yellow light, the inner envelope 50 typically has a yellow appearance when the light source 10, 12 is switched off. This is not preferred. By choosing a further diffuser having a relatively high diffusivity (FWHM between 30 and 120 degrees), the details of the inner envelope 50 are less visible, which includes the yellow appearance of the inner envelope 50. In FIG. 3B the further diffuser has a lower diffusivity (FWHM between 5 and 30 degrees). As a result the details inside the inner envelope are relatively well visible and the efficiency is higher. The beam angle of the light emitted from the light source 10 will be smaller than in case of the higher diffusivity as in FIG. 3A, but still larger than in light sources of the prior art.

To further reduce this yellow appearance of the inner envelope 50 in the light source 10, 12 according to the invention, the outer wall of the inner envelope 50, being the wall of the inner envelope 50 facing the outer envelope 30, 32, may comprise a white diffusing layer. This white diffusing layer does only marginally influence the color of the light emitted by the light source 10, 12. Still the appearance of the inner envelope 50 when the light source 10, 12 is in the off-state, may be clearly altered.

Figure 4B:
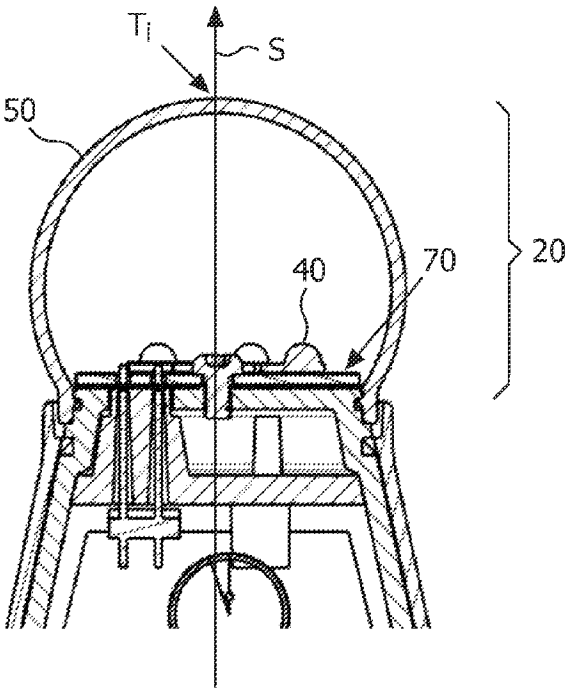
FIGS. 4A and 4B show cross-sectional views at different detail levels of the light source according to the invention.
Figure 4A:
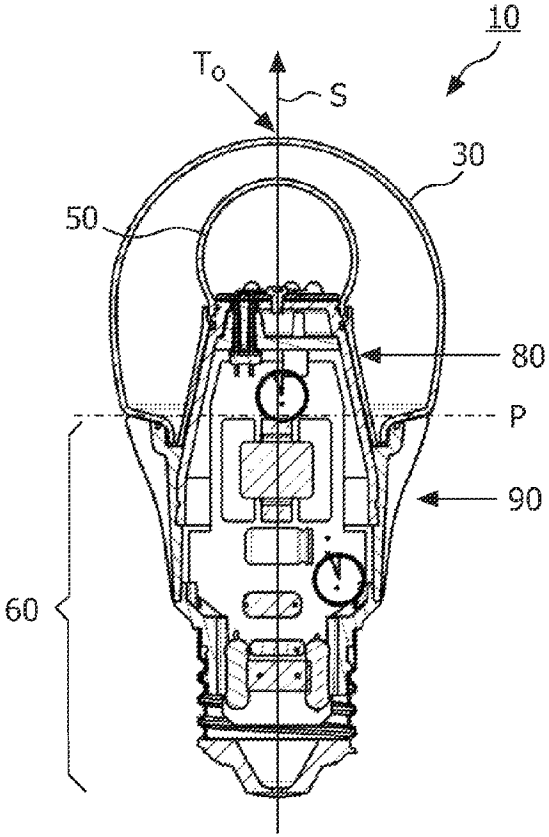

FIGS. 4A and 4B show cross-sectional views at different detail levels of the light source 10 according to the invention. FIG. 4A shows a cross-sectional view of the whole light source 10, and FIG. 4B shows a detailed cross-sectional view of the inner envelope 50 comprising the light emitting devices 40 being light emitting diode devices 40. The intersection point $T_o$ between the outer envelope 30 and the symmetry axis S is also indicated as the top $T_o$ of the outer envelope 30, indicated in FIG. 4A. The intersection point $T_i$ between the inner envelope 50 and the symmetry axis S is also indicated as the top $T_i$ of the inner envelope 50, indicated in FIG. 4B.

In FIG. 4A it can clearly be seen that the connection element 80 is a cone-shaped connection element 80 widening from the light emitter 20 toward the base 60. Furthermore, the cone-shaped connection element 80 is hollow and may provide space for additional electronics, for example, for converting power to a suitable level for the used light emitting device 40. Furthermore, the connection means 80 may have a heat-conductive function for transporting heat away from the light emitting devices 40, for example, towards the base 60 where additional heat transfer means 90 may be present such as cooling fins 90.

The circuit board 70 preferably is a flat circuit board 70 as shown in FIG. 4B as may be produced relatively cheap. However, the circuit board 70 may also be constituted of several circuit boards (not shown) which are arranged at different angles with respect to the symmetry axis S and/or with respect to each other. As can also be seen from FIG. 4B the circuit board 70 may comprise one light emitting diode 40 but may also comprise more than one light emitting diode 40. The circuit board 70 may further comprise a reflective and/or luminescent layer on a side of the circuit board 70 which faces the inner envelope 50. In such an embodiment, the reflective layer may, for example, be used to enable recycling of light and the luminescent material may be used to fine-tune the color emitted by the light source 10 and/or may be used to correct the emission characteristic of the light emitting diode 40 applied to the circuit board 70. The light emitting devices 40 may, for example, emit blue light or may emit any other color of light and may, for example, comprise phosphor-converted light sources 40 such as phosphor-converted light emitting diodes 40.

The inner envelope 50 may, for example, be manufactured via injection molding of a transparent polymer such as Polycarbonate which comprises luminescent material mixed in the Polycarbonate before molding. The luminescent material may also be applied after the Polycarbonate has been molded as a layer on the inner and/or outer surface of the inner envelope 50. Optionally an additional diffusive material such as $TiO_2$, $SiO_2$ or $Al_2O_3$ may be applied inside the Polycarbonate and/or as a layer on top of the Polycarbonate. Alternatively, the inner envelope 50 may be made from e.g. flush coating or spray coating of a glass or plastic transparent or translucent concave substrate in which the luminescent material and optionally additional diffusive material may be present in a suitable (polymer) matrix.

Alternatively, the inner envelope 50 may, for example, be manufactured via injection molding of a transparent polymer such as a silicone rubber which comprises luminescent material mixed in the silicone rubber before setting. Optionally an additional diffusive material such as $TiO_2$, $SiO_2$ or $Al_2O_3$ may be applied inside the silicone rubber.

Figure 5B:
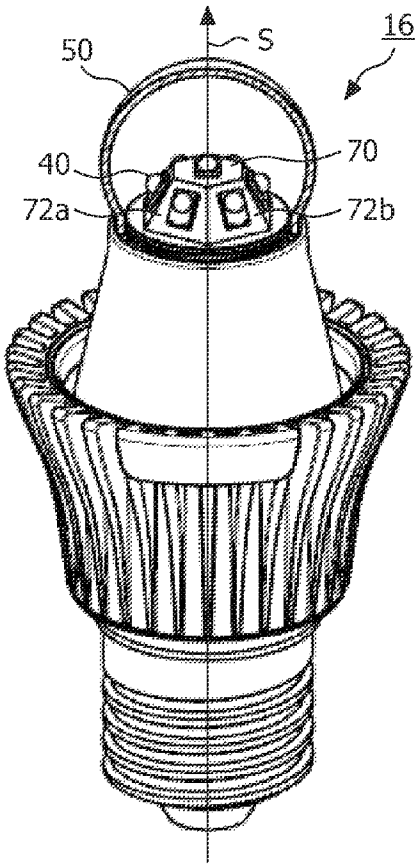
FIGS. 5A and 5B show cross-sectional views at different light sources according to the invention in which the outer envelope has been omitted.
Figure 5A:
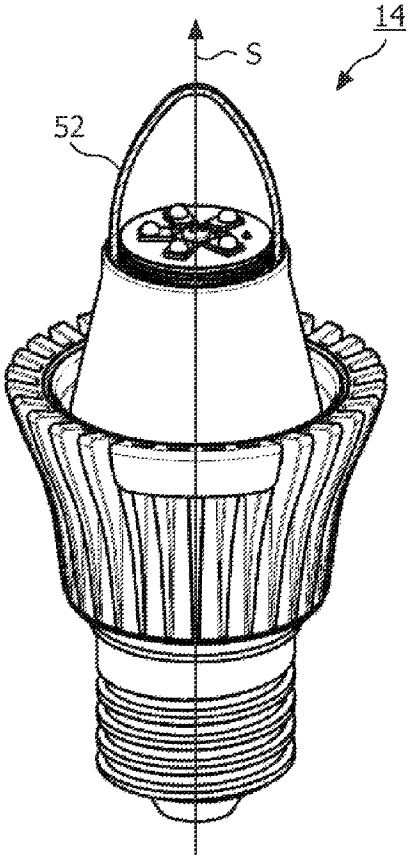

FIGS. 5A and 5B show cross-sectional views at different light sources 14, 16 according to the invention in which the outer envelope 30 has been omitted. The outer envelope 30 is not indicated in the FIGS. 5A and 5B to more clearly show the shape of the inner envelope 52 in FIG. 5A and to more clearly show the specific arrangement of the light emitting devices 40 in FIG. 5B. However, in operation, an outer envelope 30 is present as indicated in FIG. 1 and as indicated in the claims. In the embodiment shown in FIG. 5A an elongated inner envelope 52 is shown in which the dimension of the inner envelope 52 along the symmetry axis S is larger than the dimension of the inner envelope 52 in a direction perpendicular to the symmetry axis S. Such an inner envelope 52 results in a different filament effect compared to the previous embodiments in which the inner envelope 50 comprises a substantially spherical shape. In the embodiment shown in FIG. 5B the light emitting device 40 is constituted of a plurality of light emitting diodes 40 which are arranged on different circuit boards 70, 72*a*, 72*b* which are arranged at different angles with respect to the symmetry axis S and with respect to each other. Such an arrangement generates a further increased spatial emission distribution of the light source 16 as more light is emitted toward the base-plane P (not shown in FIG. 5B). To obtain a substantially homogeneous color distribution the plurality of light emitting diodes preferably emit light of substantially identical color.

The outer envelope 30 may for example be made of transparent glass. The proper diffusivity may be achieved by e.g. sand blasting or etching of the inner and/or outer surface, or by e.g. flush coating or spray coating with a proper diffusive material such as $TiO_2$, $SiO_2$ or $Al_2O_3$ in a suitable (polymer) matrix. After the coating process, the matrix material may be removed by heating. Alternatively, the outer envelope 30 may be made of a translucent plastic such as Polycarbonate or silicone rubber containing additional diffusive material. The outer envelope 30 may be manufactured by e.g. injection blow molding, injection molding or compression molding, depending on the properties of the materials used.

In one embodiment according to the invention, a red-orange nitride phosphor is applied to the inner envelope 50 (i.e., the remote luminescent element), while on the circuit board 70 at least a blue emitting light emitting diode 40 is applied and a yellow-green phosphor is applied to provide whitish light emitted from the inner envelope 50.

In a further embodiment, a yellow-green phosphor, e.g. a yellow-green garnet phosphor, is applied to the inner envelope 50 and a red-orange phosphor, e.g. a red-orange nitride phosphor, is applied on the circuit board 70 or on the light emitting diode 40 at the proximity of the blue light emitting light emitting diode 40.

A further embodiment comprises a mixture of a red-orange and a yellow-green phosphor applied to the inner envelope 50, while on the circuit board 70 at least a blue light emitting light emitting diode 40 is provided.

Alternatively, in an embodiment, a red-orange phosphor, for example, a red-orange nitride phosphor is applied to the inner envelope 50 and a yellow-green phosphor, for example, a yellow-green garnet phosphor, is applied in the outer envelope 30, while the circuit board 70 comprises at least a blue light emitting light emitting diode 40.

In a further embodiment, a blue light emitting light emitting diode 40 and a red light emitting light emitting diode 40 are both mounted on the circuit board 70, while the inner envelope 50 comprises at least a yellow-green phosphor.

In a further embodiment, a blue light and red light emitting light emitting diode 40, comprising a luminescent material that emits red-orange light upon irradiation with blue light, is mounted on the circuit board 70, while the inner envelope 50 comprises at least a yellow-green garnet phosphor.

In an even further embodiment, white light emitting light emitting diodes 40 are mounted on the circuit board 70, while the inner envelope 50 comprises a diffusive material. This embodiment does not comprise luminescent materials applied to the inner envelope 50 nor to the outer envelope 30 while still the filament effect is present.

In all configurations, the red light emitting device 40 or the red luminescent material has a peak wavelength of at least 600 nm, preferably at least 610 nm and maximum peak wavelength of 660 nm, preferably 650 nm, most preferably 640 nm.

The garnet phosphor typically comprises the general formula:

$$(Y_xLu_{1-x})_3Al_5O_{12}:Ce\ (0 \le x \le 1),$$

and the nitride phosphor typically comprises the general formula:

$$(Ca_xSr_yBa_{1-x-y})AlSiN_3:Eu\ (0 \le x \le 1,\ 0 \le y \le 1-x),\ \text{or}$$

$$(Ca_xSr_yBa_{1-x-y})_2Si_5N_8:Eu\ (0 \le x \le 1,\ 0 \le y \le 1-x)$$

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A light source comprising a light emitter arranged inside a translucent outer envelope, the translucent outer envelope being connected to a base, and further comprising a symmetry axis, an imaginary base-plane being defined substantially perpendicular to the symmetry axis and intersecting with a connection point being part of the translucent outer envelope, the connection point being a light transmitting part of the translucent outer envelope at an interface between the translucent outer envelope and the base at a furthest distance from a center (M) of the translucent outer envelope, the light emitter comprising a light emitting device and a translucent inner envelope at least partially surrounding the light emitter, wherein the light emitter arranged on a substantially flat circuit board arranged substantially parallel to the imaginary base-plane, the translucent inner envelope comprising a diffuser for diffusing at least a part of the light emitted by the light emitting device, a diameter of the translucent inner envelope being smaller than a diameter of the translucent outer envelope, the light emitter being arranged inside the translucent outer envelope at a distance from the imaginary base-plane away from the base, the light emitter is arranged on a connection element for connecting the light emitter to the base and for defining the distance between the light emitter and the imaginary base-plane, wherein the distance between the light emitter and the imaginary base-plane is chosen to generate an emission distribution in a distribution plane of at least 220 degrees full width half maximum, the distribution plane being an imaginary plane intersecting with the symmetry axis, the connection element is a cone-shaped connection element widening from the light emitter towards the base for preventing light emitted by the light emitter toward the connection point to be obstructed by the connection element, wherein the connection element is thermally connected to the light emitting device for extracting heat away from the light emitting device, and wherein the base further comprises a heat transfer fins being thermally connected to the connection element, the inner envelope and/or the outer envelope further include an at least partially reflective layer, the partially reflective layer positioned along an area of the symmetry axis to reflect at least a part of the light emitted by the light emitter towards the base and thereby increase the spatial emissions of the light source.

2. Light source according to claim 1, wherein the diffuser comprises luminescent material for converting light emitted by the light emitting device into light of a longer wavelength.

3. Light source according to claim 1, wherein the light emitting device is a light emitting diode and/or a light emitting laser diode.

4. Light source according to claim 1, wherein an optical element is arranged inside the inner envelope for generating a batwing or butterfly shaped radiation profile from the light emitting device when viewed in a cross-sectional view through the symmetry axis (S) to enhance a relative level of radiation on the inner envelope at portions away from the top of the inner envelope, the top of the inner envelope being the part of the inner envelope intersecting with the symmetry axis.

5. Light source according to claim 1, wherein a diameter of the inner envelope is smaller than or equal to 70% of the diameter of the outer envelope.

6. Light source according to claim 1, wherein the inner envelope comprises a cut-out portion for accommodating the light emitting device, and wherein a diameter of the inner envelope is larger than a diameter of the cut-out portion, the diameter of the inner envelope being measured in a direction parallel to the direction for measuring the diameter of the cut-out portion.

7. Light source according to claim 1, wherein the inner envelope comprises a full spherical shape or a partial spherical shape.

8. Light source according to claim 1, wherein the inner envelope has a larger dimension in a direction parallel to the symmetry axis compared to a dimension in a direction perpendicular to the symmetry axis.

9. Light source according to claim 1, wherein the at least partially reflective layer is arranged on a part of the inner envelope and/or on a part of the outer envelope.

10. Light source according to claim 1, wherein the heat transfer fins include cooling fins extending in a direction parallel to the symmetry axis for allowing light to be emitted from the outer envelope through gaps between the cooling fins.

11. Light source according to claim 1, wherein the outer envelope comprises a further diffuser for diffusing light transmitted through the outer envelope.

12. Light source according to claim 11, wherein the further diffuser comprises a diffusivity between 5 and 120 degrees Full Width at Half Maximum, the diffusivity being defined by a scattering behavior of a collimated pencil beam impinging on the diffuser and resulting in a spatial scattering of the impinging collimated pencil beam.

13. Light source according to claim 1 wherein a wall of the inner envelope facing the outer envelope comprises a diffusing layer.

14. A light source, comprising:

a light emitter arranged inside a translucent outer envelope:

the translucent outer envelope being connected to a base:

a base-plane defined substantially perpendicular to a symmetry axis and intersecting with a connection point being part of the translucent outer envelope;

the connection point being a light transmitting part of the translucent outer envelope at an interface between the translucent outer envelope and the base at a furthest distance from a center of the translucent outer envelope;

the light emitter including:

an LED based light emitting device;

a translucent spherical inner envelope at least partially surrounding the light emitter, wherein the light emitter is arranged on a substantially flat circuit board arranged substantially parallel to the imaginary base-plane;

the translucent inner envelope having an inner envelope diameter and having an inner wall of luminescent material and an outer wall of a white diffusing layer;

a diffuser associated with the inner envelope for diffusing at least a part of the light emitted by the light emitting device, the diffuser causing part of the impinging light to be scattered substantially in multiple directions and towards the base-plane;

the inner envelope diameter being smaller than a diameter of the translucent outer envelope;

the light emitter arranged on a connection element which thermally connects the light emitter to the base;

the inner envelope being connected at the connection element at a cut-out portion formed as a planar cut through the inner envelope for accommodating the light emitting device;

the inner envelope diameter larger than a diameter of the cut-out portion thereby causing the spherical inner envelope to bulge outward from the cut-out portion;

the light emitter being arranged inside the translucent outer envelope at a distance from the imaginary base-plane away from the base;

wherein the light emitter is arranged on the connection element within the inner envelope at a distance between the base such that light output from the light emitter and the light source is at least 220 degrees FWHM.

* * * * *